US005921417A

United States Patent [19]

Mull

[11] Patent Number: 5,921,417

[45] Date of Patent: Jul. 13, 1999

[54] LARGE DIAMETER SAFETY CLOSURE

[75] Inventor: Jayna L. Mull, Evansville, Ind.

[73] Assignee: Rexam Plastics Inc., Evansville, Ind.

[21] Appl. No.: 09/075,079

[22] Filed: May 8, 1998

[51] Int. Cl.[6] ..... B65D 55/02

[52] U.S. Cl. ..... 215/216; 215/334

[58] Field of Search ..... 215/216, 334

[56] References Cited

U.S. PATENT DOCUMENTS

| | | | |
|---|---|---|---|
| 3,450,289 | 6/1969 | Esposito, Jr. . | |
| 3,776,407 | 12/1973 | Cistone . | |
| 3,844,438 | 10/1974 | St. Pierre et al. . | |
| 3,917,097 | 11/1975 | Uhlig . | |
| 3,938,715 | 2/1976 | Bogert . | |
| 3,949,893 | 4/1976 | Uhlig . | |
| 4,383,618 | 5/1983 | Dougherty . | |
| 4,452,363 | 6/1984 | Davis . | |
| 4,548,329 | 10/1985 | Curry . | |
| 4,732,288 | 3/1988 | Morris, Sr. | 215/214 |
| 4,756,435 | 7/1988 | Schick et al. . | |
| 5,381,911 | 1/1995 | Teicher et al. | 215/216 |
| 5,449,077 | 9/1995 | Seidler | 215/216 |
| 5,462,182 | 10/1995 | Opresco | 215/216 |
| 5,577,624 | 11/1996 | Berta et al. . | |
| 5,671,853 | 9/1997 | Herr | 215/216 |

*Primary Examiner*—Stephen K. Cronin
*Attorney, Agent, or Firm*—Middleton & Reutlinger; Daniel C. Stelter

[57] ABSTRACT

A safety closure providing a top wall, an outer skirt depending downwardly from an outer perimeter of the top wall, an inner skirt depending downwardly from the top wall, the inner skirt being disposed radially inwardly from the outer skirt, the inner skirt being coaxial with the outer skirt, a locking tab depending downwardly from a lower end of the outer skirt, a first thumb pad, and, a second thumb pad, the second thumb pad being opposed the first thumb pad about the locking tab, the first thumb pad being angularly offset from the locking tab by a first predetermined angle, the second thumb pad being angularly offset from the locking tab by the first predetermined angle, whereby applying a squeezing force between the first thumb pad and the second thumb pad moves the locking tab radially outwardly.

15 Claims, 7 Drawing Sheets

LARGE DIAMETER SAFETY CLOSURE

BACKGROUND OF THE INVENTION

1. Technical Field of the Invention

The present invention relates to safety closures for use on oversized containers. More particularly, the present invention relates to a safety closure for use on an oversized container wherein the safety closure is provided with a plurality of means to remove the safety closure from the oversized container.

2. Description of the Related Art

It is well-known in the prior art to provide a container for storing therein pills, capsules, tablets or the like, wherein a predetermined number of pills may be removed therefrom for consumption, and wherein the remaining pills are stored in the container for future consumption. However, because the pills are oftentimes medicated, it is well-known in the prior art to seal the container with a safety closure having a locking mechanism provided thereby to inhibit access to the pills by individuals of tender age who typically do not understand the danger of over-consumption of the pills stored therein.

For example, U.S. Pat. No. 5,577,624 to Berta, et al., U.S. Pat. No. 5,449,077 to Seidler, U.S. Pat. No. 3,844,438 to St. Pierre, et al., and U.S. Pat. No. 4,548,329 to Curry each teaches a child-resistant closure for use on a container, wherein access thereto requires an individual to first overcome a locking mechanism, such as, for example, cooperating lugs, projections, ratchets or the like.

It is furthermore desirable to provide an oversized container for use in storing pills therein, such as, for example, for use by an elderly individual or an individual suffering from a disease, such as, for example, arthritis, who is oftentimes incapable of handling and manipulating the locking mechanisms provided on safety closures typical of the prior art. However, locking mechanisms typical of the prior art are not readily adaptable for use on an oversized or a large-diameter safety closure. Thus, it is desirable to provide a safety closure for use on an oversized container, wherein the safety closure is provided with a locking mechanism to inhibit access thereto by individuals of tender age, and wherein the safety closure and the oversized container may be easily handled and manipulated by elderly individuals or individuals who suffer from a disease such as arthritis.

It is furthermore desirable to provide a safety closure for use on an oversized container, wherein the safety closure is provided with a locking mechanism to inhibit access thereto by individuals of tender age, and wherein the safety closure includes a plurality of different means by which the safety closure may be removed from the oversized container.

SUMMARY OF THE INVENTION

The present invention is for a safety closure for use on an oversized container suitable for storing therein pills, capsules, tablets or the like, wherein a predetermined number of pills may be removed therefrom for consumption, and wherein the remaining pills are stored in the container for future consumption. More particularly, the present invention is for a safety closure for use on an oversized container, wherein the safety closure inhibits access to the pills by individuals of tender age, and wherein an elderly individual, or an individual suffering from a disease such as arthritis, may remove the safety closure from the oversized container in any one of a number of ways and with minimal discomfort or complication.

It is an object of the present invention to provide a safety closure for use on a container suitable for storing therein pills, capsules, tablets or the like, wherein a predetermined number of pills may be removed therefrom for consumption, and wherein the remaining pills are stored in the container for future consumption.

It is another object of the present invention to provide a safety closure for use on a container, wherein the safety closure includes a locking mechanism provided thereby to inhibit access thereto by individuals of tender age.

It is still another object of the present invention to provide a safety closure for use on an oversized container, wherein the safety closure includes a locking mechanism provided thereby to inhibit access thereto by individuals of tender age, and wherein the safety closure may be easily handled and manipulated by elderly individuals or individuals suffering from a disease such as arthritis.

It is yet another object of the present invention to provide a safety closure for use on an oversized container, wherein the safety closure includes a locking mechanism provided thereby to inhibit access thereto by individuals of tender age, and wherein a plurality of means are provided for removing the safety closure from the oversized container.

A safety closure according to a preferred embodiment of the present invention includes a top wall, an outer skirt depending downwardly from an outer perimeter of the top wall, an inner skirt depending downwardly from the top wall, the inner skirt being disposed radially inwardly from the outer skirt, the inner skirt being coaxial with the outer skirt, a locking tab depending downwardly from a lower end of the outer skirt, a first thumb pad, and, a second thumb pad, the second thumb pad being opposed the first thumb pac about the locking tab, the first thumb pad being angularly offset from the locking tab by a first predetermined angle, the second thumb pad being angularly offset from the locking tab by the first predetermined angle, whereby applying a squeezing force between the first thumb pad and the second thumb pad moves the locking tab radially outwardly.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
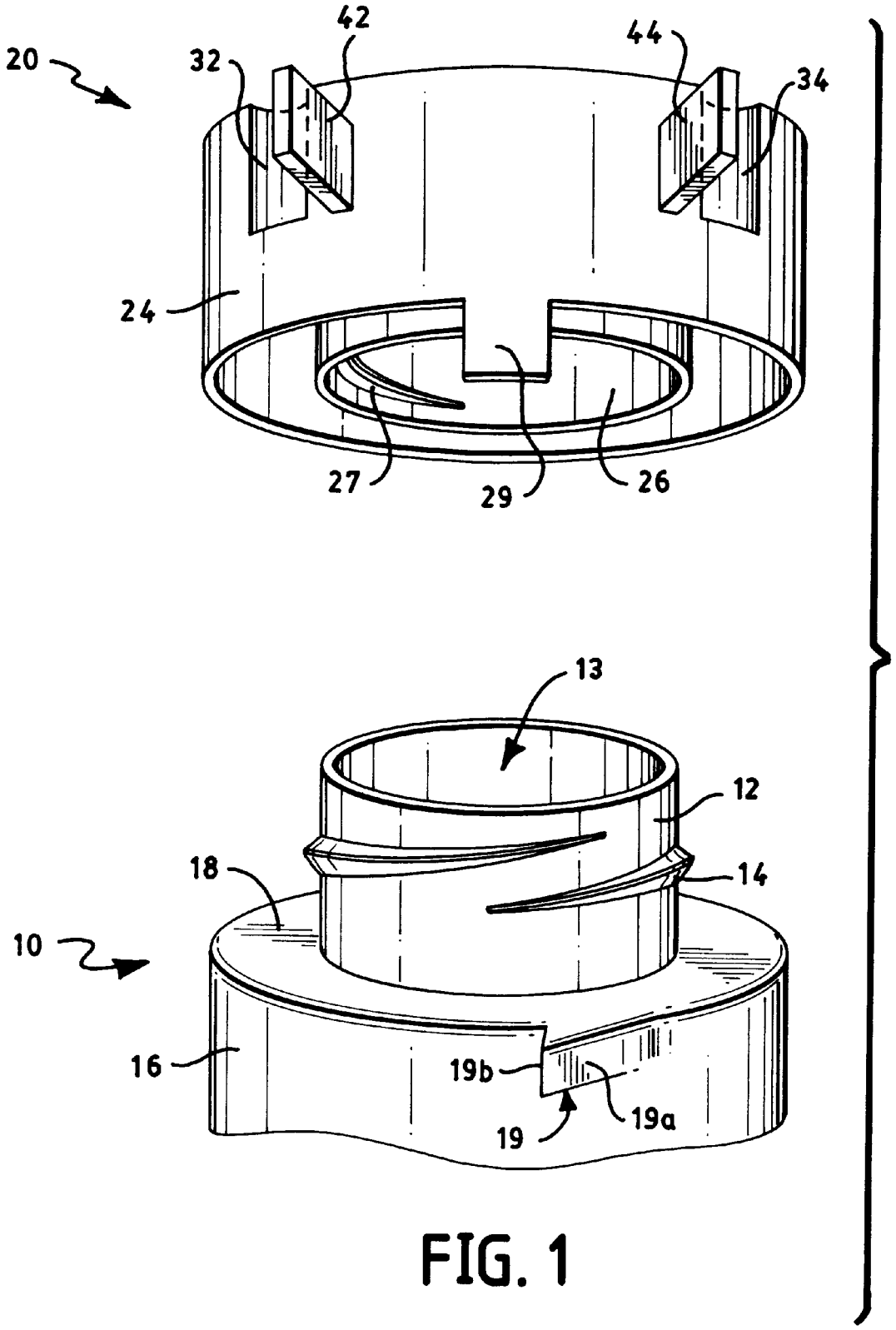
FIG. 1 is an exploded perspective view of a safety closure according to a preferred embodiment of the present invention shown with a container neck portion.
Figure 2:
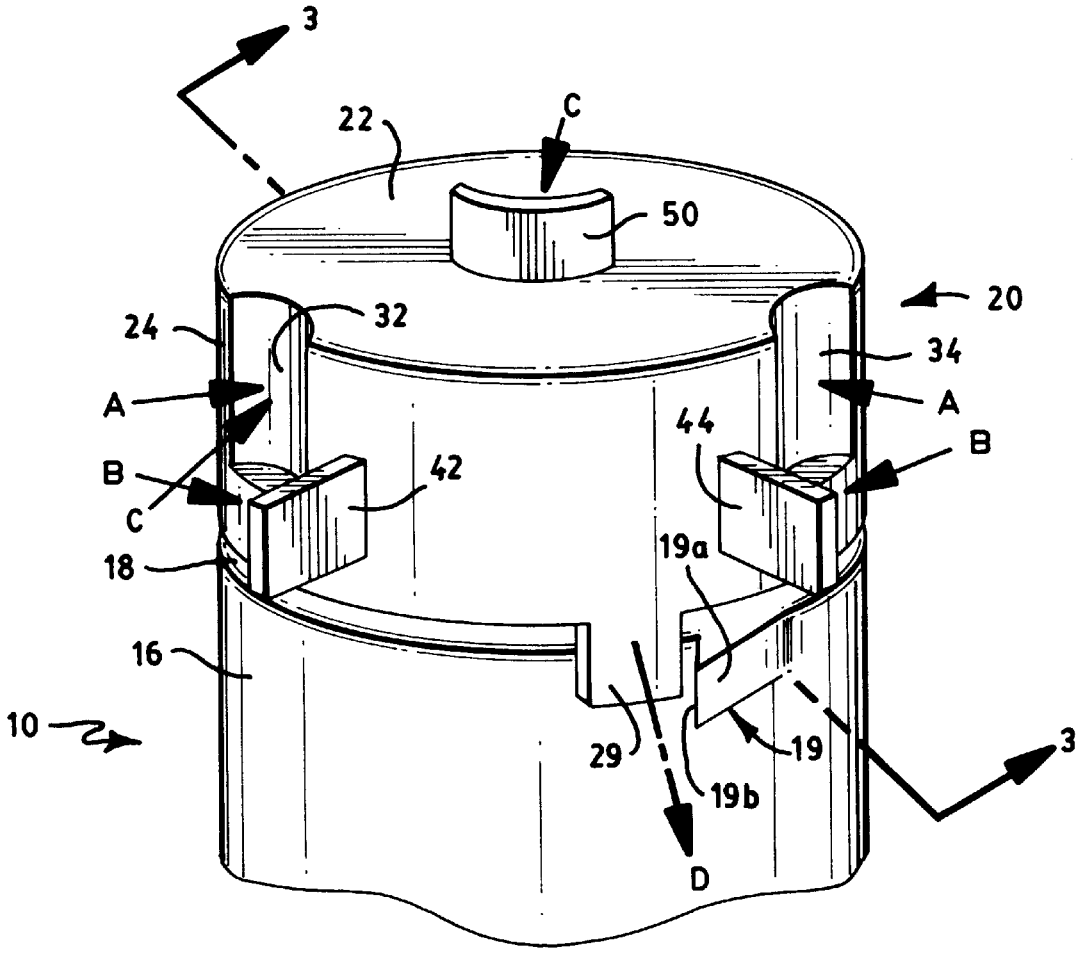
FIG. 2 is a perspective view of the safety closure of FIG. 1 shown affixed to the container neck portion of FIG. 1.
Figure 3:
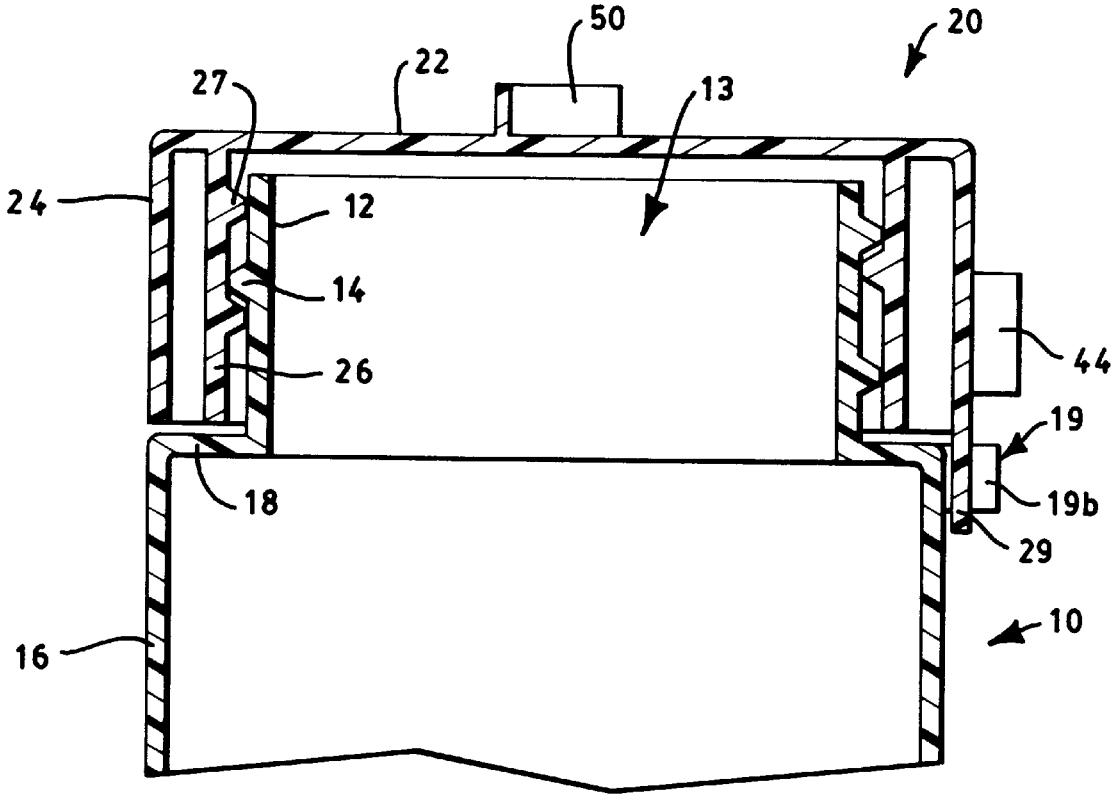
FIG. 3 is a section view of the safety closure of FIG. 1 shown affixed to the container neck portion of FIG. 1 and taken along section line 3—3 of FIG. 2.

With reference to FIGS. 1–3, a safety closure 20 according to a preferred embodiment of the present invention for use on an oversized container 10 includes a top wall 22, an outer skirt 24 depending downwardly from an outer periphery of the top wall 22, and an inner skirt 26 depending downwardly from the top wall 22 and being spaced radially inwardly from the outer skirt 24 and coaxial thereto. The safety closure 20 is preferably an integrally-molded construction of a flexible, resilient plastic, such as, for example, polyethylene or polypropylene, although other materials may be substituted in place thereof without departing from either the spirit or the scope of the present invention.

The container 10 includes a neck portion 12 having an external thread 14 projecting outwardly therefrom and a main body portion 16 (an upper end thereof only being shown in the Figures) connected to the neck portion 14 by a shoulder 18. The neck portion 12 and the thread 14 are sized and shaped to threadingly engage an internal thread 27 projecting inwardly from an inner surface of the inner skirt 26, thereby sealing an opening 13 is provided through the neck portion 12 by which pills, capsules, tablets or the like (not shown) may be deposited within the container body portion 16 for storage therein. A locking lug 19 projects radially outwardly from the main body portion 16 of the container 10 near the shoulder 18. The container 10 is preferably an integrally-molded construction of a flexible, resilient plastic, such as, for example, polyethylene or polypropylene, although any suitable material may be substituted in place thereof without departing from either the spirit or the scope of the present invention.

The container body portion 16 preferably is of a large diameter, such as, for example, approximately 6 inches, so that an individual may easily grasp, handle and manipulate same. Cooperatively, the safety closure outer perimeter and the safety closure outer skirt 24 preferably are of a large diameter, such as, for example, approximately 6 inches, so that an individual may easily grasp, handle and manipulate same.

A locking tab 29 depends downwardly from a lower end of the outer skirt 24 and is sized to engage the container locking lug 19. As the safety closure 20 is threadingly affixed to the container neck portion 12, the closure locking tab 29 rides up and along a ramped surface 19*a* provided on the container locking lug 19, thereby deforming the flexible outer skirt 24 radially outwardly. Further downward rotation of the safety closure 20 relative to the container neck portion 12 causes the locking tab 29 to pass angularly beyond an abutment 19*b* defined by the locking lug 19, at which point the resilient closure outer skirt 24 snaps the locking tab 29 therebehind and prevents removal rotation of the safety closure 20 relative to the container neck portion 12. Removal of the safety closure 20 from the container neck portion 12 requires an individual to first unseat the closure locking tab 29 from behind the abutment 19*b* to overcome same and to permit removal rotation of the safety closure 20 thereover.

Figure 4:
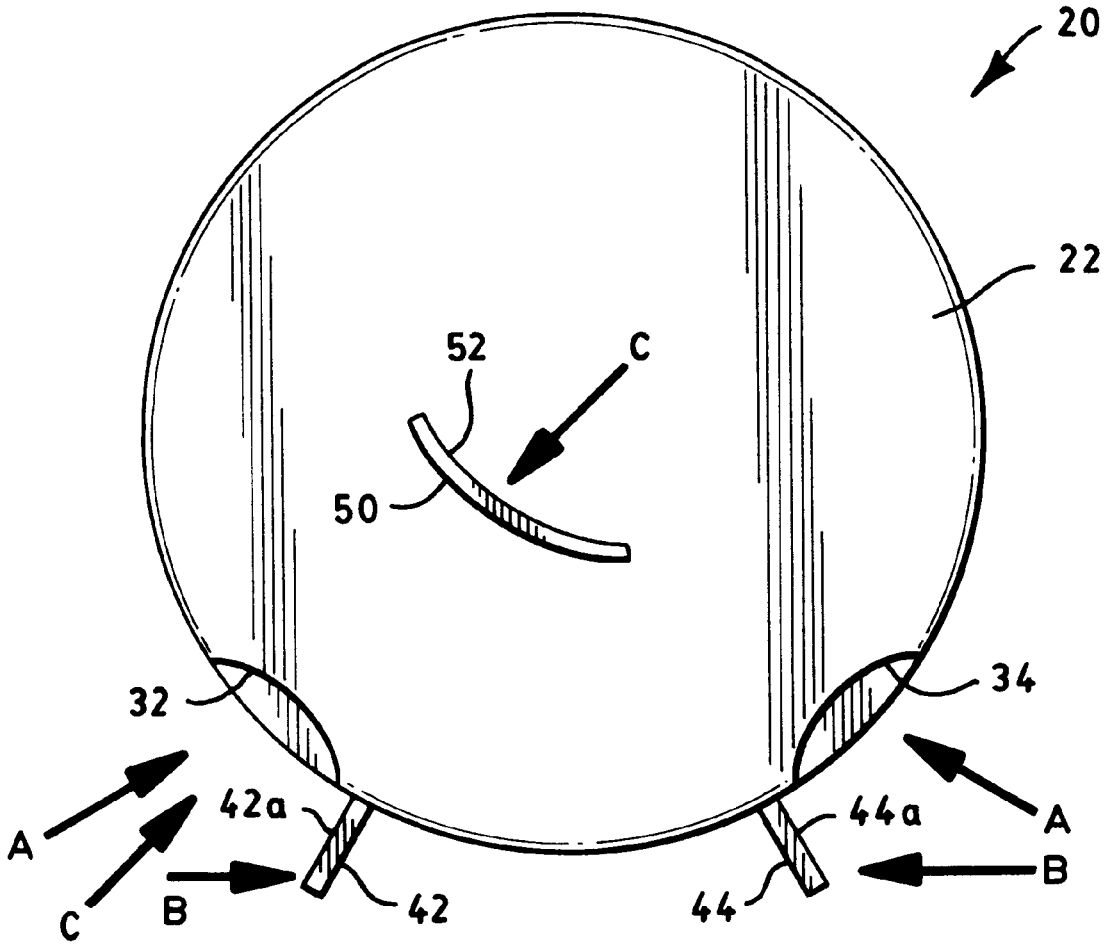
FIG. 4 is a top view of the safety closure of FIG. 1.

With additional reference to FIG. 4, the safety closure 20 is provided with a plurality of discreet mechanisms by which the safety closure outer skirt 24 may be manipulated for the closure locking tab 29 to overcome the container locking lug 19. The safety closure 20 may alternatively be provided with any one of these mechanisms, absent from the others, without substantially affecting the operation or performance thereof. However, the preferred safety closure 20 includes each of the plurality of mechanisms so that an individual may select and use whichever mechanism best suits that individual's particular needs.

More particularly, first and second contact regions, shown as a pair of recessed thumb pads 32, 34 are provided on an outer surface of the outer skirt 24, each thumb pad 32, 34 being opposed to one another about the locking tab 29 and being angularly offset from the locking tab 29 on either side thereof by approximately 45 degrees. The thumb pads 32, 34 are concave and include a substantially cylindrical shape depending downwardly from the top wall 22 for a predetermined distance, although they may be sized and shaped differently, such as, for example, rectangularly, arcuately or elliptically. The thumb pads 32, 34 may extend from the top wall 22 to either a center portion of the outer skirt 24 (as shown in the Figures), or may extend completely to the lower end thereof. An inner surface of the thumb pads 32, 34 may be provided with ridges, knurls or other surface effects (not shown) to facilitate substantially slip-free gripping thereof.

Figure 5:
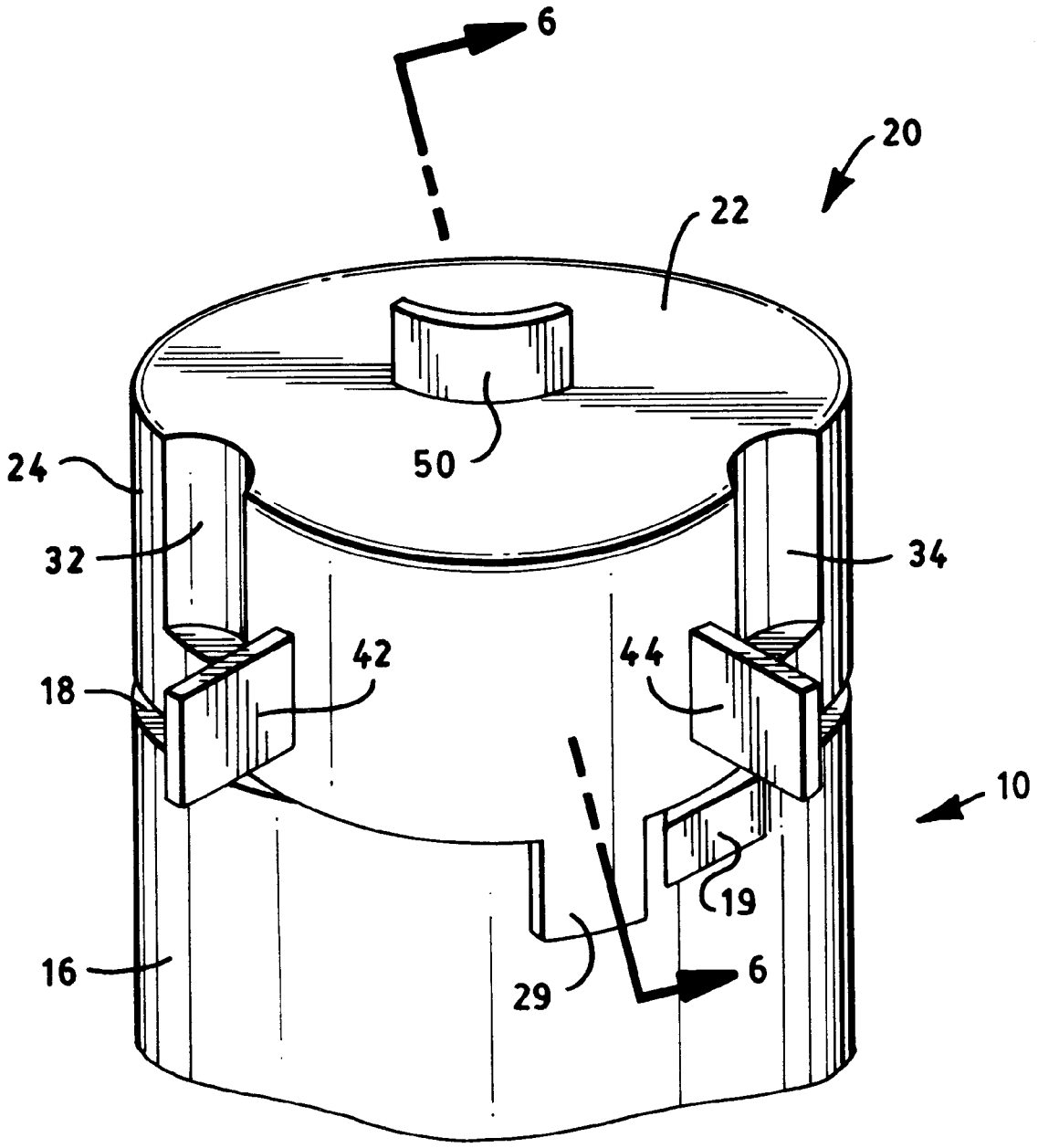
FIG. 5 is a perspective view of the safety closure of FIG. 1 shown with deformation affixed to the container neck portion of FIG. 1.
Figure 6:
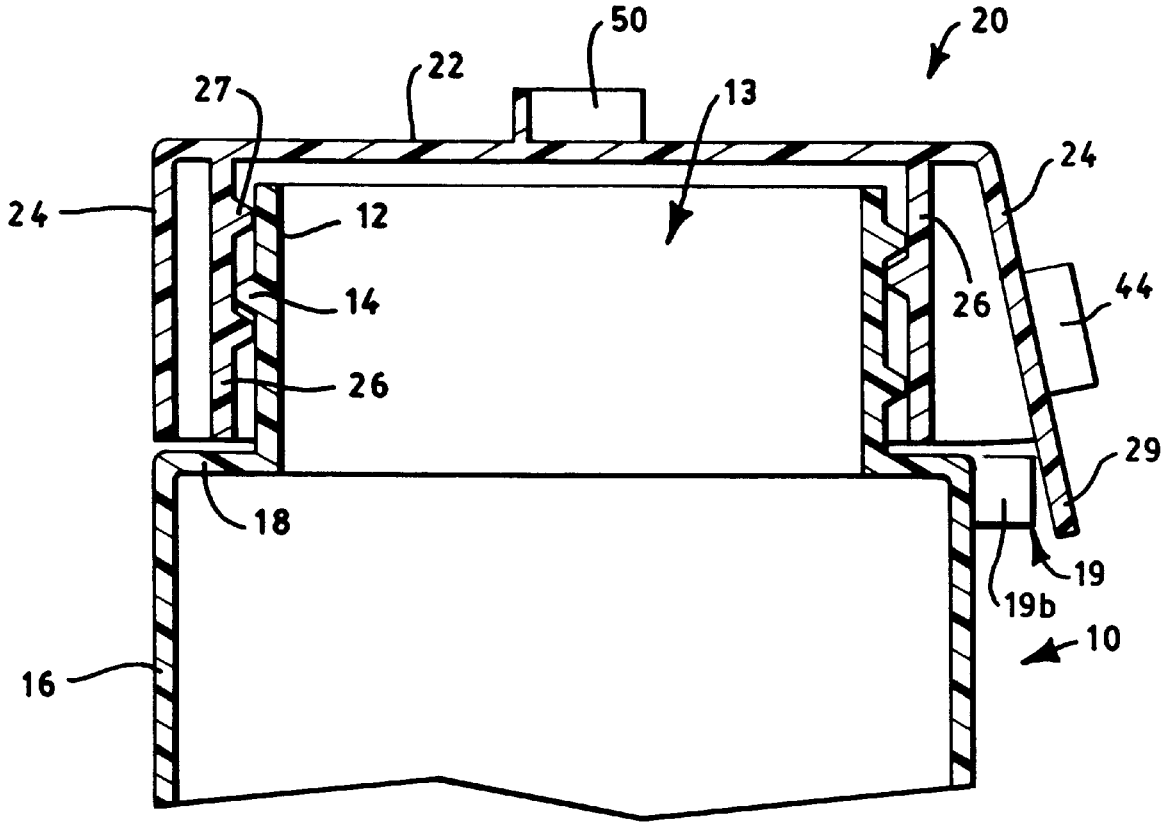
FIG. 6 is a section view of the safety closure of FIG. 1 shown with deformation affixed to the container neck portion of FIG. 1 and taken along section line 6—6 of FIG. 5; and, FIG. 7 is an exploded perspective view of a safety closure according to an alternative embodiment of the present invention shown with a container neck portion.

With additional reference to FIGS. 5 and 6, the locking tab 29 is caused to move radially outwardly of the locking lug 19 by an individual's gripping the thumb pads 32, 34, such as, for example, by contacting a first thumb pad 32 with the individual's thumb and by contacting a second thumb pad 34 with the knuckle portion of the individual's forefinger, and applying a squeezing force to the thumb pads 32, 34, such force being indicated generally in the Figures by reference letter "A". The lower end of the outer skirt 24 near the locking tab 29 is thereby deformed radially outwardly from the container neck portion 12 a sufficient distance to permit the locking tab 29 to overcome the locking lug 19. Removal rotation is then applied to the safety closure 20 to remove the safety closure 20 from the container neck portion 12.

A pair of wings 42, 44 are integrally-molded with and project outwardly from an outer surface of the outer skirt 24, each wing 42, 44 being opposed to one another about the locking tab 29 and being angularly offset from the locking tab 29 on either side thereof by approximately 45 degrees. When the safety closure 20 is provided with both the thumb pads 32, 34 and the wings 42, 44, the wings 42, 44 are preferably angularly offset inwardly from their respective thumb pads 32, 34 a nominal distance towards the locking tab 29. The wings 42, 44 are sized and shaped to permit an individual's gripping of opposed, outwardly-facing surfaces 42*a*, 44*a* thereof and applying inwardly-directed squeezing forces, being indicated generally in the Figures by reference letter "B". The lower end of the outer skirt 24 near the locking tab 29 is thereby deformed radially outwardly from the container neck portion 12 a sufficient distance to permit the locking tab 29 to overcome the locking lug 19. Removal rotation is then applied to the safety closure 20 to remove the safety closure 20 from the container neck portion 12.

The wings 42, 44 each include a substantially rectangular shape and substantially rectangular cross-section, although any suitable shape, size or cross-section may be substituted in place thereof without departing from either the spirit or the scope of the present invention. The wings 42, 44 must be able to sustain the force "B" to cause deformation of the outer skirt 24 without breaking off therefrom. For example, the wings 42, 44 may include an outward taper by which the cross-sectional area thereof is larger immediately adjacent to the outer skirt 24 than towards an outermost tip thereof.

An arcuate rib 50 is integrally-molded with and projects axially upwardly from the top wall 22 to cooperate with either or both of the thumb pads 32, 34 to provide another mechanism by which an individual may remove the safety closure 20 from the container neck portion 12. More particularly, the outer skirt 24 of the safety closure 20 is deformed so that the locking tab 29 is moved radially outwardly from the locking lug 19 a sufficient distance to permit removal rotation of the safety closure 20 relative to the container neck portion 12 by an individual's gripping the safety closure 20, such as, for example, by contacting either thumb pad 32, 34 with the individual's thumb and by contacting an inner arcuate surface 52 of the rib 50 with the knuckle portion of the individual's forefinger, and applying a squeezing force therebetween, such force being indicated generally in the Figures by reference letter "C". The lower end of the outer skirt 24 near the locking tab 29 is thereby deformed radially outwardly from the container neck portion 12 a sufficient distance to permit the locking tab 29 to overcome the locking lug 19. Removal rotation is then applied to the safety closure 20 to remove the safety closure 20 from the container neck portion 12.

Figure 7:
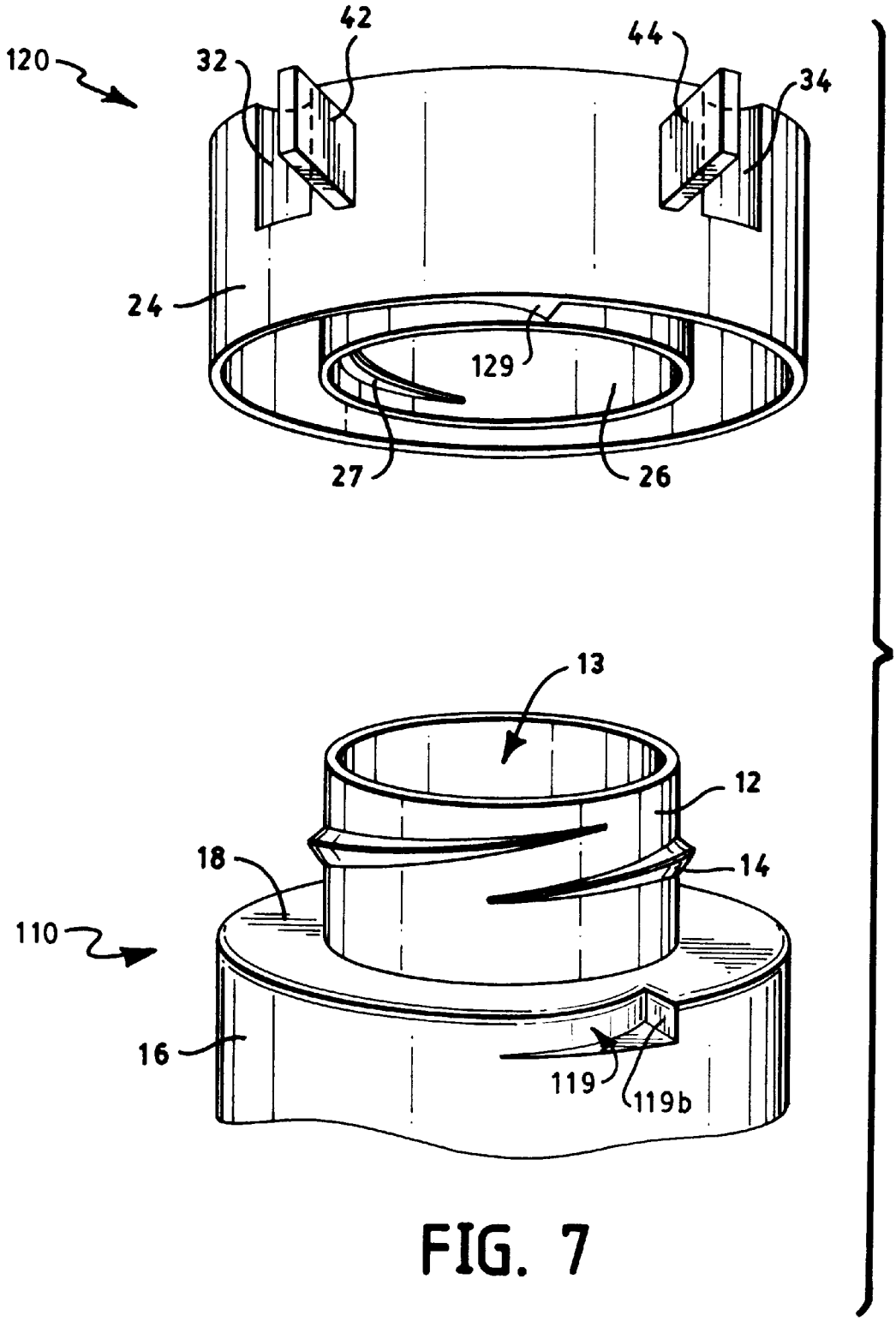

With reference to FIG. 7, a safety closure 120 according to an alternative embodiment of the present invention for use on an oversized container 110 includes many components in common with the safety closure 20 according to the preferred embodiment hereof hereinabove described, and like reference numerals are intended to represent like components. However, the safety closure 120 according to the present embodiment includes a locking tab 129 projecting radially inwardly from a lower end of the outer skirt 24 towards the inner skirt 26. The container 110 includes a locking recess 119 projecting radially inwardly from the main body 16 near the shoulder 118. The locking recess 119 is sized and shaped to seat the locking tab 129 therein.

As the safety closure 120 is threadingly affixed to the container neck portion 12, the closure locking tab 129 rides along an outer surface of the container main body portion 16, thereby deforming the flexible outer skirt 24 radially outwardly. Further downward rotation of the safety closure 120 relative to the container neck portion 12 causes the locking tab 129 to pass angularly beyond an abutment 119*b* defined by the locking recess 119, at which point the resilient closure outer skirt 24 snaps the locking tab 129 therein and prevents removal rotation of the safety closure 120 relative to the container neck portion 12. Removal of the safety closure 120 from the container neck portion 12 requires an individual to first unseat the closure locking tab 129 from behind the abutment 119*b* as hereinabove described with respect to the preferred embodiment hereof to overcome same and to permit removal rotation of the safety closure 120 thereover.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A safety closure, comprising:

a top wall;

an outer skirt depending downwardly from an outer perimeter of said top wall;

an inner skirt depending downwardly from said top wall, said inner skirt being spaced radially inwardly from said outer skirt, said inner skirt being coaxial with said outer skirt;

a locking tab projecting from a lower end of said outer skirt; and, a first means for causing deformation of said outer skirt, said first deformation-causing means including first and second contact regions formed on said outer skirt, said first and second contact regions each being angularly opposed from one another about said locking tab, each of said first and second contact regions being angularly offset from said locking tab by a first predetermined acute angle, whereby applying a squeezing force between said first and second contact regions moves said locking tab radially outwardly.

2. The safety closure of claim 1, wherein:

said first contact region includes a first thumb pad; and, said second contact region includes a second thumb pad.

3. The safety closure of claim 2, wherein:

said first contact region includes a recessed portion; and, said second contact region includes a recessed portion.

4. The safety closure of claim 2, further comprising:

a second means for causing deformation of said outer skirt, said second deformation-causing means including first and second wings projecting radially outwardly from said outer skirt, said first and second wings each being angularly opposed from one another about said locking tab, each of said first and second wings being angularly offset from said locking tab by a second predetermined acute angle, said second predetermined angle being less than said first predetermined angle, whereby applying a squeezing force between said first and second wings moves said locking tab radially outwardly.

5. The safety closure of claim 2, further comprising:

a rib projecting upwardly from said top wall, whereby applying a squeezing force between said first deformation-causing means and said rib moves said locking tab radially inwardly.

6. The safety closure of claim 1, wherein:

said first contact region includes a first wing projecting radially outwardly from said outer skirt; and, said second contact region includes a second wing projecting radially outwardly from said outer skirt.

7. The safety closure of claim 1, wherein:

said safety closure is oversized.

8. The safety closure of claim 1, wherein:

said locking tab projects axially downwardly from said lower end of said outer skirt.

9. The safety closure of claim 1, wherein:

said locking tab projects radially inwardly from said lower end of said outer skirt towards said inner skirt.

10. A safety closure, comprising:

a top wall;

an outer skirt depending downwardly from an outer perimeter of said top wall;

an inner skirt depending downwardly from said top wall, said inner skirt being spaced radially inwardly from said outer skirt, said inner skirt being coaxial with said outer skirt;

a locking tab projecting from a lower end of said outer skirt;

a first thumb pad; and, a second thumb pad, said second thumb pad being opposed said first thumb pac about said locking tab, said first thumb pad being angularly offset from said locking tab by a first predetermined angle, said second thumb pad being angularly offset from said locking tab by said first predetermined angle, whereby applying a squeezing force between said first thumb pad and said second thumb pad moves said locking tab radially outwardly.

11. The safety closure of claim 10, further comprising:

a first wing projecting radially outwardly from said outer skirt;

a second wing projecting radially outwardly from said outer skirt, said first wing being angularly offset from said locking tab by a second predetermined angle, said second wing being angularly offset from said locking tab by said second predetermined angle, said second predetermined angle being less than said first predetermined angle, whereby applying a squeezing force between said first wing and said second wing moves said locking tab radially outwardly.

12. The safety closure of claim 10, further comprising:

a rib projecting upwardly from said top wall, whereby applying a squeezing force between said first deformation-causing means and said rib moves said locking tab radially inwardly.

13. The safety closure of claim 10, wherein:

said first thumb pad includes a recessed portion; and, said second thumb pad includes a recessed portion.

14. The safety closure of claim 10, wherein:

said locking tab projects axially downwardly from said lower end of said outer skirt.

15. The safety closure of claim 10, wherein:

said locking tab projects radially inwardly from said lower end of said outer skirt towards said inner skirt.

* * * * *